United States Patent [19]

Crandall

[11] Patent Number: 4,883,247

[45] Date of Patent: Nov. 28, 1989

[54] PICTURE HANGER AND METHOD OF USING

[76] Inventor: Neil H. Crandall, 309 Watauga Ave., Elizabethton, Tenn. 37643

[21] Appl. No.: 211,863

[22] Filed: Jun. 27, 1988

[51] Int. Cl.[4] ..... A47F 7/14

[52] U.S. Cl. ..... 248/542; 248/489; 248/495

[58] Field of Search ..... 248/542, 479, 495, 489, 248/544, 466, 475.1, 476, 496, 497

[56] References Cited

U.S. PATENT DOCUMENTS 2,681,194 6/1954 Halvorsen ..... 248/495

2,965,339 12/1960 Denton ..... 248/495

3,912,216 10/1975 Gano ..... 248/479 X

*Primary Examiner*—Alvin C. Chin-Shue

*Attorney, Agent, or Firm*—Malcolm G. Dunn

[57] ABSTRACT

A picture hanger having a T-shaped wall mount member for fastening to a wall and a picture mount member for fastening to a picture frame or the like, the T-shaped wall mount member having a pendulum member for determining horizontal level of the T-shaped wall mount member on the wall and being connectable to the picture mount member and attached picture frame or the like to form an assembly; and the method of using the picture hanger by mounting the assembly on the wall temporarily at an approximate desired location, separating the picture mount member and attached picture frame from the T-shaped wall mount member, leveling the T-shaped wall mount member on the wall to establish an exact desired location and re-forming the assembly by securing the picture mount member and picture frame to the T-shaped wall mount member.

11 Claims, 5 Drawing Sheets

PICTURE HANGER AND METHOD OF USING

TECHNICAL FIELD

The present invention is directed to an improved picture hanger for readily hanging in a level manner picture frames, mirrors and other articles similarly to be supported on walls, and to the method of using same.

BACKGROUND ART

In hanging pictures, mirrors and other articles on walls, one of the problems usually faced is to accomplish the job in such manner that the picture, mirror or other article ends up being level with respect to the horizon or, in other words, it is aligned in a plane parallel to normal horizontal reference lines about the room wherein the wall is located.

Some picture frame leveling devices that are known in the art include U.S. Pat. Nos. 3,955,790; 4,100,681; 4,208,802; 4,212,123; and 4,597,554.

U.S. Pat. No. 3,955,790 discloses a wall hanger device that includes a free swinging plumb member for leveling the wall hanger device. The device is formed from sheet metal and has an involved structural design which would not lend itself to being less expensively injection molded, as is possible with the more simplified design of applicant's invention because it would not readily be withdrawable from the mold.

U.S. Pat. No. 4,100,681 discloses a transparent tape having blister-like cavities at regular intervals each partially filled with liquid to form a separate spirit or bubble level. The base member of the tape has a pressure sensitive adhesive enabling a section of the tape including one of the blisters to be severed from the rest of the tape and be affixed to the top of a framed picture. In this manner, a person may note when he has suitably leveled the framed picture.

U.S. Pat. No. 4,208,802 discloses a disposable holder and a reusable bubble level, which is held in a pocket formed in the holder. The holder is attached to a mounting plate, which in turn is secured by adhesive to the bottom rail of a picture frame. When the picture frame is determined to be level by use of the bubble level, the holder is then broken free from the mounting plate and the bubble level may be re-used with another separate holder and mounting plate.

U.S. Pat. No. 4,212,123 discloses a pivoting indicator member which may be mounted along one rear vertical edge of a picture frame. As long as the picture frame is level the indicator member will be vertically disposed behind the picture frame and will not be visible from the front of the picture frame. When the picture frame is not level, the indicator member will be inclined so as to be visible from the front of such picture frame.

U.S. Pat. No. 4,597,554 discloses a two-part mounting set for hanging a display board, picture or the like from a wall. A centrally located pocket or notch is provided within a wall mounting fixture, and a board mounted fixture includes a centrally located tab which extends downwardly from the board mounted fixture and has corresponding dimensions to those of the pocket or notch in the wall mounting fixture. The tab on the one part is designed to fit within the pocket or notch on the other part. Each fixture includes clips for supporting a small spirit level by which each fixture is made level, or one spirit level may be used instead of two and thus the wall mounting fixture is leveled first, and then is used on the board mounted fixture. Thereafter, the display assembly connected to the board mounted fixture may be removed at will from the wall mount fixture and remounted in its established level position.

Other known patents, such as U.S. Pat. Nos. 1,887,159, 2,530,892, 3,261,578, 3,298,655, and 4,458,872 disclose various constructions of picture frame and mirror supports wherein a member on one bracket fits within a member on another bracket to connect the picture frame or mirror to a wall.

An object of the present invention, therefore, is to provide a picture hanger that will enable picture frames, mirrors and similar type articles to be hung on a wall in a level position, to be removed from the wall as for cleaning purposes and to be rehung in the same leveled position without requiring further leveling.

Another object of the invention is to provide a picture hanger having a built-in leveling device.

Still another object of the invention is to provide a picture hanger that, upon being made level, will continue to remain level irrespective of any vibrations that may occur to the wall on which the picture hanger may be mounted.

A further object of the invention is to provide a unique method of hanging a picture frame, mirror or similar type article.

Other objects inherent in the nature of the invention disclosed will thus become apparent to those skilled in the art to which the invention pertains from the description given herein.

DISCLOSURE OF THE INVENTION

In accordance with the present invention, I provide a picture hanger of an improved type and comprising a T-shaped wall mount member and a picture mount member. The T-shaped wall mount member has a horizontal portion and a vertical portion extending intermediately of and below the horizontal portion. The horizontal portion has a flat horizontal upper surface. The T-shaped wall mount member is securable on one side thereof to a wall of a room and has on the other side an elongated pendulum member pivotally mounted therefrom for indicating when the T-shaped wall mount member has been oriented on the wall to align the horizontal portion in a plane parallel to normal horizontal reference lines about the room. The T-shaped wall mount member defines within the aforementioned flat horizontal upper surface two spaced similarly shaped apertures extending downwardly into the horizontal portion. The picture mount member has a horizontally extending portion and is securable on one side thereof to the rear face of a horizontal frame member of a picture frame. The picture mount member has extending downwardly therefrom at right angles to the general axis of the horizontally extending portion a pair of spaced tongue members. Each tongue member is similarly configured to one of the aforementioned two spaced similarly shaped apertures so as to engage and slide therewithin in close conformity therewith for securing the picture mount member to the T-shaped wall mount member.

The horizontal portion of the T-shaped wall mount member defines within its flat horizontal upper surface and between the aforementioned two spaced similarly shaped apertures a third aperture in the shape of a cross. The cross is formed by two slots intersecting at right angles and crossing at their midpoints. One of the intersecting slots terminates in an arcuate surface at a predetermined distance below the horizontal upper surface of the T-shaped wall mount member. The other of the intersecting slots extends completely through the horizontal portion of the T-shaped wall mount member, and the elongated pendulum member is insertable lengthwise through this latter intersecting slot. The pendulum member has at its upper end a pivot pin extending at right angles transversely beyond each side of the pendulum member for seating within and against the aforementioned arcuate surface for pivotally supporting the pendulum member from the T-shaped wall mount member.

The elongated pendulum member has at its free extremity a V-shaped tip. The free extremity of the aforementioned vertical portion of the T-shaped wall mount member defines a centrally located inverted V-shaped opening the apex of which and the V-shaped tip of the pendulum member meet when the horizontal portion of the T-shaped wall mount member is aligned in a plane parallel to normal horizontal reference lines about a room.

The pair of spaced tongue members on the picture mount member extends at right angles to the general axis of the horizontally extending portion of the picture mount member and is also inclined at an angle transversely to the general axis of the horizontally extending portion of the picture mount member. Such angle may preferably be about 3 degrees.

Each of the pair of spaced tongue members on the picture mount member has a rectangular configuration with the length of the rectangular configuration parallel to the general axis of the horizontally extending portion being greater than the width.

The picture mount member may also define within its surface on one side a longitudinally extending groove parallel to the general axis of the horizontally extending portion of the picture mount member. A longitudinally extending flat surfaced spacer member may then be provided which is adapted to be interposed between the surface of a horizontal frame member of a picture frame and one side of the picture mount member. The spacer member has on one side thereof a longitudinally extending rib configured in cross-section to fit within the longitudinally extending groove in the picture mount member so as to align the spacer member with the picture mount member.

The longitudinally extending flat surfaced spacer member may also define on its other side a longitudinally extending groove parallel to the longitudinally extending rib on the opposite side of the spacer member. The latter mentioned groove is adapted to receive a longitudinally extending rib of another longitudinally extending flat surfaced spacer member.

The T-shaped wall mount member, the pendulum member and the picture mount member are each formed in one piece by injection molding.

The aforementioned horizontal frame member of a picture frame may comprise a metal moulding which defines within its rear face a C-shaped channel. The C-shaped channel has a bottom wall, a pair of opposite facing side walls adjacent to and connecting to either side of the bottom wall, and a pair of flanges each adjacent to and connected to one of the side walls. The picture mount member also includes a threaded member and an adaptor member, which is connected by the threaded member to the picture mount member and is adapted to fit within the C-shaped channel of the metal moulding. Upon rotation of the threaded member, the adaptor member is caused to be clamped against the aforementioned pair of flanges to secure the picture mount member to the picture frame.

The adaptor member is a flat surfaced elongated member and defines a centrally located threaded hole for receipt therethrough of one end of the threaded member. The adaptor member has at least two angled flat edge surfaces each diagonally opposite the other. Each flat edge surface is adapted to engage one of true opposite facing side walls of the C-shaped channel prior to the adaptor member being clamped against the pair of flanges and upon partial rotation of the adaptor member as the threaded member is being rotated.

In the method of hanging a picture frame by use of the picture hanger heretofore described, the picture mount member is secured intermediate the length of an uppermost horizontal frame member of the picture frame. The T-shaped wall mount member has on one side thereof releasable adhesive means and is secured to the picture mount member to form the picture frame, picture mount member and T-shaped wall mount member into an assembly. The method involves positioning the aforementioned assembly against a wall of a room in an approximate desired location for the assembly. The assembly is then pressed against the wall until the releasable adhesive means on one side of the T-shaped wall mount member forms an adhered position on the wall. The picture mount member and picture frame are separated from the T-shaped wall mount member from the aforementioned adhered position by lifting the picture frame upwardly until the tongue members on the picture mount member slide free from the apertures in the T-shaped wall mount member. The T-shaped wall mount member is manually released free from the adhered position by pulling it away from the wall while maintaining the T-shaped wall mount member closely to the aforementioned approximate desired location. The T-shaped wall mount member is then oriented until the pendulum member indicates that the horizontal portion of the T-shaped wall mount member is aligned in a plane parallel to normal horizontal reference lines about a room. The T-shaped wall mount member is pressed against the wall to establish a horizontally aligned exact desired location, and is then suitably permanently secured to the wall at the aforementioned exact desired location. The assembly is re-formed by securing the picture mount member and the picture frame to the T-shaped wall mount member.

BRIEF DESCRIPTION OF THE DRAWINGS

The details of my invention will be described in connection with the accompanying drawings, in which.

BEST MODE FOR CARRYING OUT THE INVENTION

Figure 1:
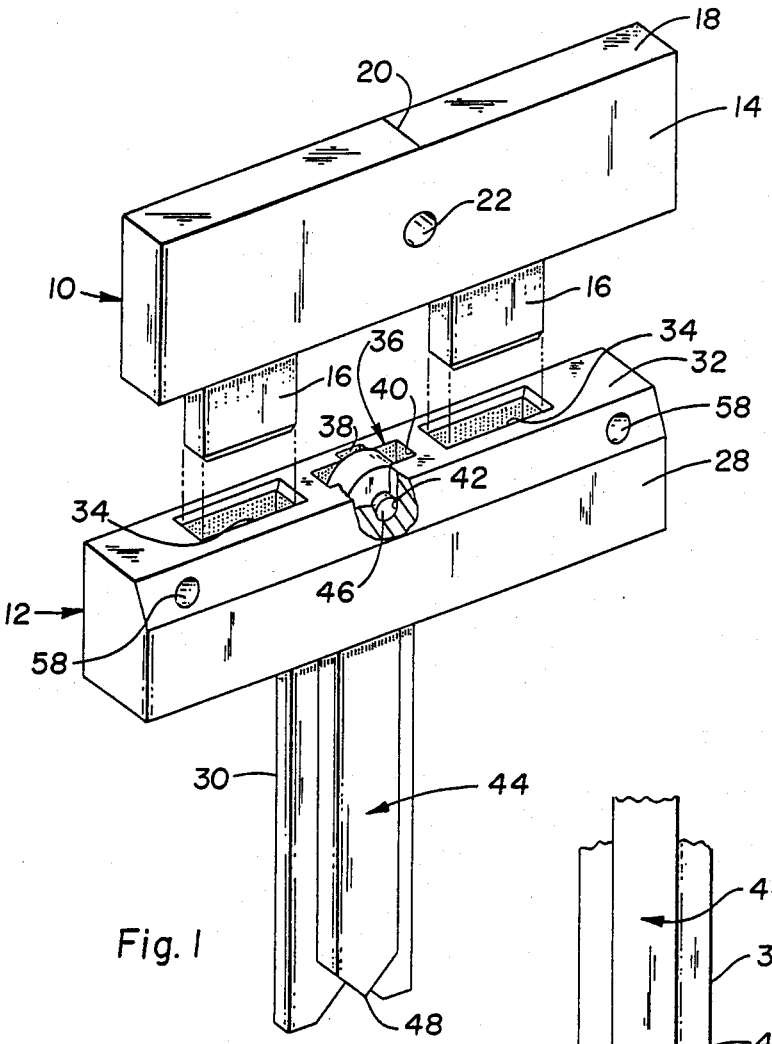
FIG. 1 is an exploded isometric view of a picture mount member and a T-shaped wall mount member.

In reference to the drawings and initially FIG. 1, 10 designates a picture mount member and 12 designates a T-shaped wall mount member of the improved picture hanger.

The picture mount member 10 has a horizontally extending portion 14, and extending downwardly therefrom at right angles to the general axis of the horizontally extending portion is a pair of spaced tongue members 16. Each tongue member may be preferably rectangular in configuration so that the length of the rectangular configuration parallel to the general axis of the horizontally extending portion 14 is greater than the width.

The upper flat horizontal surface 18 of the picture mount member is provided intermediate of its length with a center indicating line 20 which may be suitably formed as by a raised rib or by indentation or scribing for enabling the picture mount member to be readily centered with respect to the center of a horizontal frame member of a picture frame.

Figure 3:
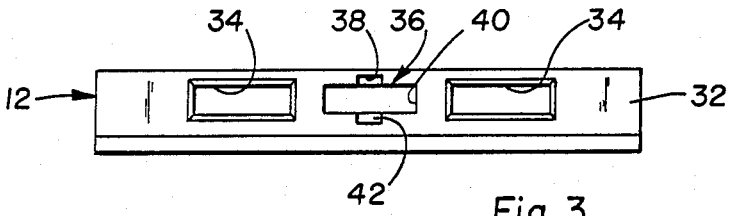
FIG. 3 is a plan view of the flat horizontal upper surface of the T-shaped wall mount member illustrating two spaced similarly shaped apertures and a third aperture in the shape of a cross.
Figure 4:
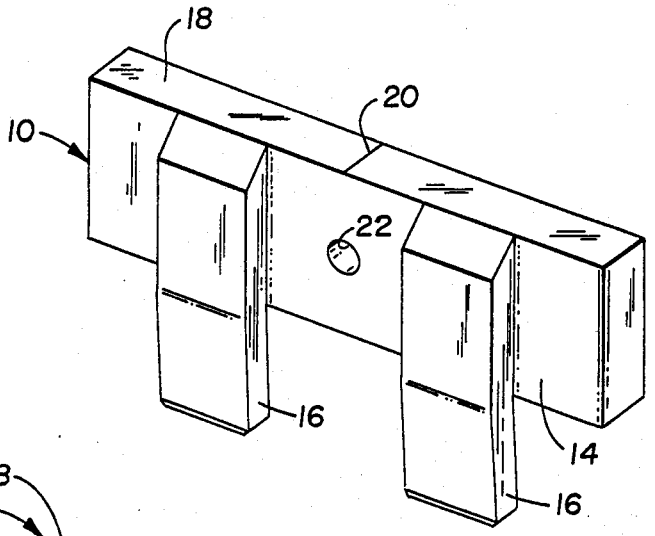
FIG. 4 is an isometric view of the rear face of the picture mount member illustrating the pair of spaced tongue members.

The spaced tongue members 16 of the picture mount member 10 not only extend at right angles to the general axis of the horizontally extending portion, as previously mentioned, and as illustrated in FIG. 3, but also are inclined at an angle A transversely to such general axis, as illustrated in FIG. 4. The angle A may preferably be about 3 degrees, for purposes to be herein described The picture mount member 10 may also be provided with an aperture 22 extending centrally through the horizontally extending portion and through which, preferably, a screw may extend for securing the picture mount member to a picture frame, as illustrated, for example, in FIG. 6 by the screw 24 shown in phantom lines extending into a picture frame 26.

The T-shaped wall mount member 12 has a horizontal portion 28 and a vertical portion 30 extending intermediately of and below the horizontal portion. The horizontal portion 28 has a flat horizontal upper surface 32 within which are defined two spaced similarly shaped apertures 34 which extend downwardly into the horizontal portion 28 (i.e., only part way into the horizontal portion) and conform in configuration to the configuration of the tongue members 16 of the picture mount member 10.

The flat horizontal upper surface 32 of the T-shaped wall mount member also defines between the two apertures 34 a third aperture 36, which is in the shape of a cross formed by two slots 38 and 40 intersecting at right angles and crossing at their midpoints. One of the intersecting slots 38 terminates in an arcuate surface 42 (FIG. 1) at a predetermined distance below the horizontal upper surface 32. The other intersecting slot 40 extends completely through the horizontal portion of the T-shaped wall mount member. An elongated pendulum member 44 is insertable lengthwise through intersecting slot 40 and has at its upper end a pivot pin 46 extending at right angles transversely beyond each side of the pendulum member for seating within and against the arcuate surface 42. In this manner, the elongated pendulum member is pivotally supported from the T-shaped wall mount member.

Figure 2:
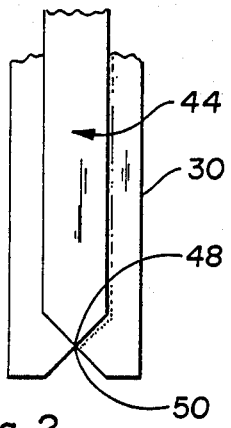
FIG. 2 is a front elevational view of a portion of the elongated pendulum member and of the vertical portion of the T-shaped wall mount member and illustrating the V-shaped tip of the pendulum member meeting with the apex of the centrally located inverted V-shaped opening of the vertical portion of the T-shaped wall mount member.

The elongated pendulum member 44 is formed at its free extremity into a V-shaped tip 48. The vertical portion 30 of the T-shaped wall mount member defines a centrally located inverted V-shaped opening 50. When the horizontal portion 28 of the T-shaped wall mount member is aligned horizontally the V-shaped tip 48 of the pendulum member 44 and the apex of the inverted V-shaped opening 50 of the vertical portion 30 will meet, as illustrated in FIG. 2.

Figure 5:
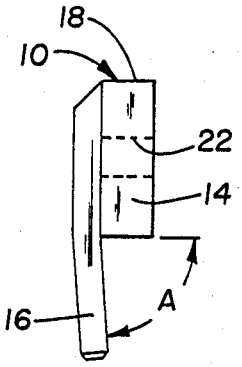
FIG. 5 is a side elevation view of the picture mount member illustrating the tongue members being inclined at an angle transversely to the general axis of the horizontally extending portion of the picture mount member.

In reference to FIGS. 4 and 5, the spaced tongue members 16 extend at right angles to the general axis of the horizontally extending portion 14 of the picture mount member 10 and are also inclined at an angle, indicated by A in FIG. 5, transversely to the general axis of the horizontally extending portion 14. Angle A is preferably about 3 degrees. The purpose for inclining the spaced tongue members will become apparent when reference is made to FIG. 6 where it is shown how the lower portion of the picture frame 26 is caused by the inclined tongue members 16 to bear or rest against the surface of the wall 52 of a room (not shown).

The method of hanging a picture frame or mirror or other similar articles is thought to be unique. The picture mount member 10 is first secured intermediate the length of an uppermost horizontal frame member of the picture frame 26. The center indicating line 20 on the upper flat horizontal surface 18 of the picture mount member enables one to readily position the picture mount member intermediately of the horizontal picture frame member.

The T-shaped wall mount member 12 of its rear face (i.e., the side that is to be positioned against a wall) along the horizontal portion 28 may have secured thereto adhesive strips 54 of a type that will enable the T-shaped wall mount member to be releasably secured to the wall, as distinguished from being more or less permanently secured thereto.

The T-shaped wall mount member 12 and its pivotally mounted elongated pendulum member 44 are secured to the picture mount member by inserting the similarly configured spaced tongue members 16 into the similarly configured apertures 22 in the picture mount member. The picture frame, picture mount member and the T-shaped wall mount member are thus formed into an assembly.

The method, therefore, comprises positioning the assembly against the wall of a room in an approximate desired location. Such "approximate desired location" means that the person practicing this method positions the picture frame and attached picture hanger appropriately centered and spaced on the wall between the floor and ceiling at the desired height. The assembly is then pressed against the wall until the adhesive strips (or any other suitable adhesive medium) on the rear face of the T-shaped wall mount member forms an adhered position on the wall. The picture mount member 10 and picture frame 26 are separated from the T-shaped wall mount member without releasing the T-shaped wall mount member from the aforementioned adhered position by lifting the picture frame upwardly until the tongue members 16 on the picture mount member slide free from within the apertures 34 in the T-shaped wall mount member.

The T-shaped wall mount member is then manually released free from its adhered position by pulling it away from the wall while maintaining the T-shaped wall mount member closely to the aforementioned approximate desired location. The T-shaped wall mount member is then oriented on the wall until the pendulum member 44 indicates that the horizontal portion 28 of the T-shaped wall mount member is aligned in a plane parallel to normal horizontal reference lines about the room wherein the wall is located. More specifically, when the V-shaped tip 48 of the elongated pendulum member is seen to meet the apex of the inverted V-shaped opening 50 of the vertical portion 30 of the T-shaped wall mount member, this will be the indication that the horizontal portion 28 of the T-shaped wall mount member is now horizontally aligned.

Figure 6:
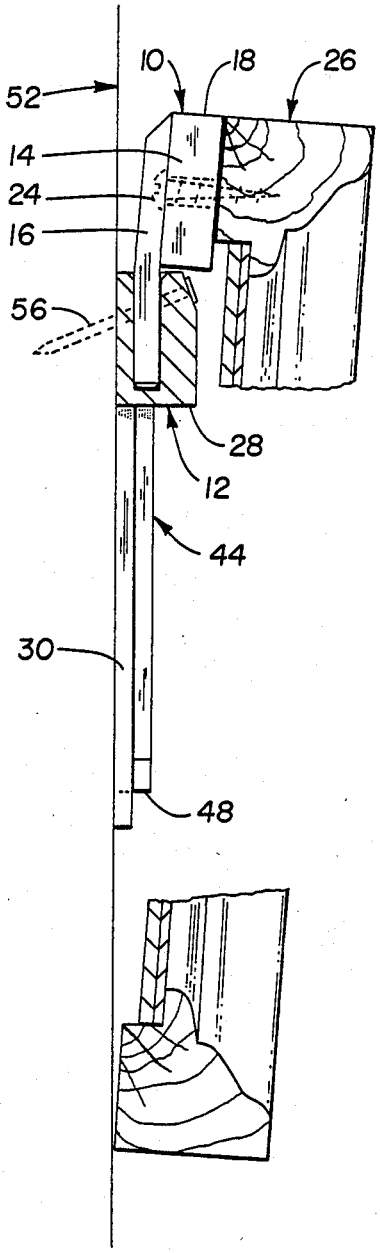
FIG. 6 is an elevational view of the assembly of the picture frame, picture mount member and T-shaped wall mount member secured to a wall of a room illustrating the T-shaped wall mount member and picture frame partly in cross-section with the vertical length of the picture frame partly broken away to show how the picture frame at its lower end is caused to bear against the wall due to the angled inclination of the tongue members of the picture mount member.
Figure 7:
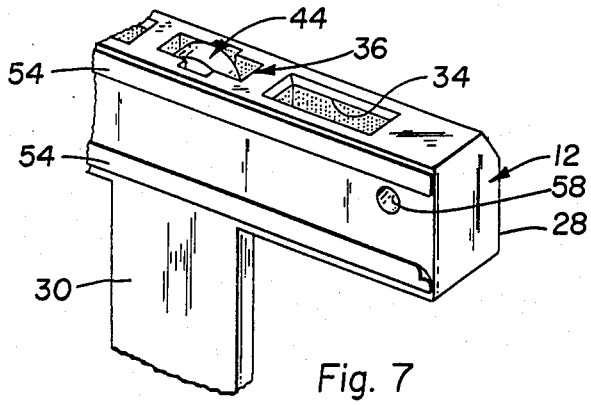
FIG. 7 is a fractional isometric view of the T-shaped wall mount member and illustrating on the rear side thereof adhesive strips for enabling the T-shaped wall mount member to be adhered to a wall of a room.

After such alignment, the T-shaped wall mount member is pressed against the wall to establish a horizontally aligned exact desired location, the adhesive strips 54 serving once again to hold the horizontally oriented T-shaped wall mount member temporarily in adhered position against the wall 52. The T-shaped wall mount member 12 is then suitably permanently secured at the aforementioned exact desired location, such as by use of nail 56 (FIG. 6) extending through each of the two nail apertures 58 (FIG. 1). The nail apertures are preferably formed at on inclined angle through the horizontal portion 28 of the T-shaped wall mount member, as shown in FIG. 6.

The final step of the method involves re-forming the aforementioned assembly by securing the picture mount member 10 and picture frame 26 to the T-shaped wall mount member. As shown in FIG. 1, for example, the edges of the apertures 34 in the picture mount member are also beveled, and the end surfaces of the tongue members 16 are beveled to facilitate entry of the tongue members into the respective apertures.

In the method described, therefore, the picture frame, mirror, or other article may be hung on the wall, may be readily removed for cleaning, or for painting the wall or for whatever purpose, and then readily rehung again in exact horizontal alignment without any further alignment being necessary.

The elongated pendulum member is intended to remain installed on the T-shaped wall mount member so that it may be readily re-used again should the picture frame need to be re-located elsewhere in the future. If the pendulum member were to be removed, it could easily be misplaced over the intervening years that picture frames usually remain in one location.

The picture mount member, T-shaped wall mount member and pendulum member comprising the picture hanger are preferably each formed in one piece by injection molding from suitable plastic materials. Some plastic materials may be considered to be more suitable than others when considering the frictional characteristics of their surfaces. The tongue members on the picture mount member should freely slide into and out of the apertures in the T-shaped wall mount member.

One would normally align the upper flat horizontal surface 18 of the picture mount member 10 with the horizontal frame member of a picture frame. If, however, one of the nails 56 were to be driven into the wall in such manner as to force the T-shaped wall mount member slightly out of the desired horizontal alignment, the screw 24, which attaches the picture mount member to the picture frame, could be loosened to change the alignment of the picture mount member relative to the picture frame and then re-tightened.

Figure 8:
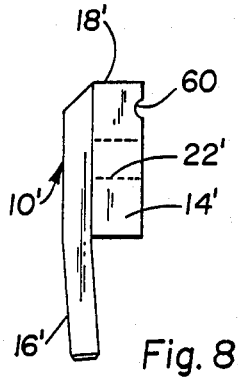
FIG. 8 is a side elevational view or an alternate embodiment of the picture mount member illustrating a longitudinally extending groove defined within one surface on one side of the picture mount member.
Figure 9:
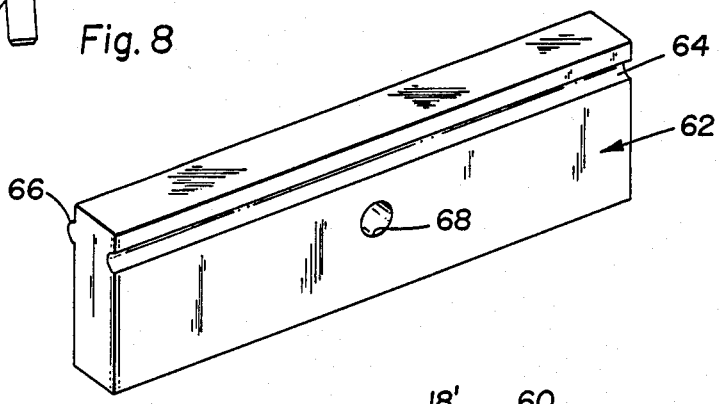
FIG. 9 is an isometric view of a longitudinally extending flat surfaced spacer member defining on one side a longitudinally extending rib and on its other side a longitudinally extending groove, the spacer member to be used with the picture mount member illustrated in FIG. 8.
Figure 10:
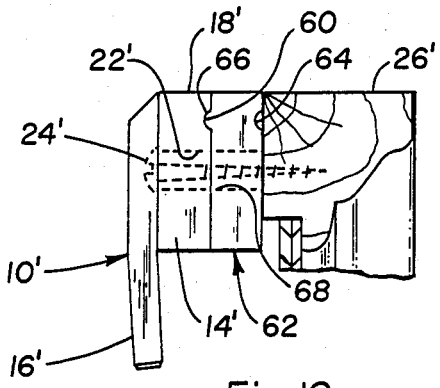
FIG. 10 is a side elevational view. of the picture mount member of FIG. 8 and the longitudinally extending flat surfaced spacer member of FIG. 9 assembled together and illustrating the rib fitting within the groove.

In reference to FIGS. 8, 9 and 10, an alternate embodiment is illustrated and which serves a purpose to be described.

The picture mount member 10' defines within its surface on one side thereof a longitudinally extending groove 60, which extends parallel to the general axis of the horizontally extending position 14'. A longitudinally extending flat surfaced spacer member 62 is provided and is adapted to be interposed between the surface on a horizontal frame member of a picture frame 26' and one side of the picture mount member 10', as shown in FIG. 10. The spacer member, which may also be injection molded from suitable plastic materials, defines on one surface a longitudinally extending groove 64 and on the other side surface a longitudinally extending rib 66. The groove and rib are each parallel with respect to each other and parallel to the general axis of the length of the horizontally extending portion 14'. As may be observed from FIG. 10, the rib 66 on the spacer member fits within the groove 60 on the picture mount member 10'. Any number of spacer members 62 may be employed, with their respective ribs 66 each fitting within the groove 64 of an adjacent spacer member.

In a situation, for example, where a stretcher frame supporting an oil painting on canvas may extend to about one-half inch rearwardly of the supporting picture frame, one or more spacer members may be used to extend in effect the thickness of the picture frame so as to prevent the stretcher frame from coming into contact with the wall.

In another example, an ornate outer picture frame may not be suitable for securing a picture mount member thereto. A more suitable supporting frame. However, may be recessed within the rear of the ornate outer frame and thus the spacer members interposed between the more suitable supporting frame and a picture mount member 10' will enable the latter to be connected to a T-shaped wall mount member secured in place on a wall. Screw 24' may be made long enough to extend through the aperture 22' in the picture mount member, the aperture 68 in the spacer member 62, and into the picture frame 26'.

Similar elements heretofore described with respect to another embodiment and not specifically mentioned with respect to this embodiment are identified with the same reference number but primed to show that it represents an alternate embodiment.

Figure 13:
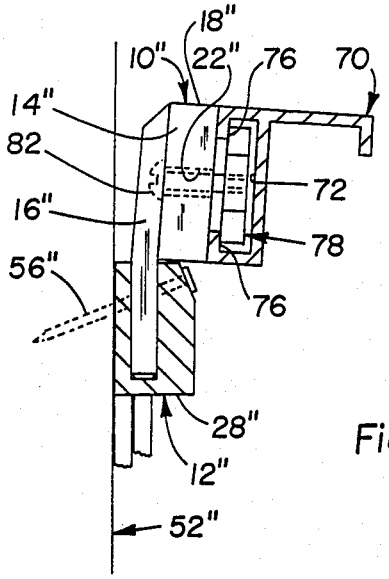
FIG. 13 is a fractional side elevational view of the assembly of the picture frame, picture mount member and T-shaped wall mount member secured to a wall of a room and illustrating the T-shaped wall mount member and picture frame in cross-section and the adaptor member being clamped against the pair of flanges of the C-shaped channel.
Figure 11:
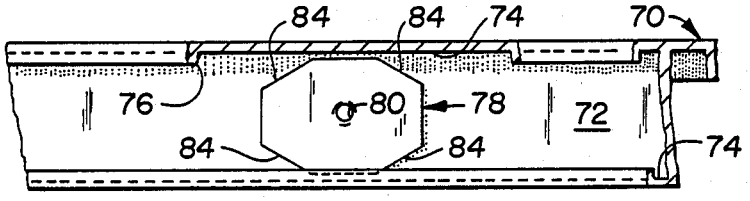
FIG. 11 is a rear elevational view of a fractional length of a horizontal frame member of a metal moulding type of picture frame illustrating an adaptor member seated within the C-shaped channel of the horizontal frame member with a portion of one of the flanges of such horizontal frame member broken away.
Figure 12:
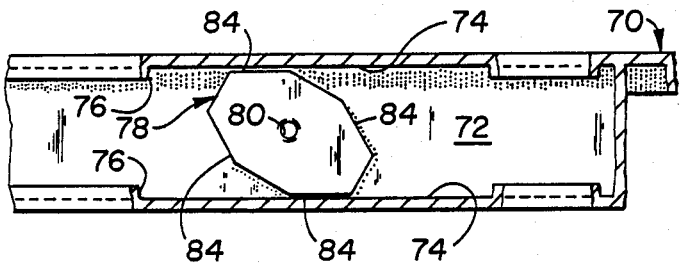
FIG. 12 is a view similar to FIG. 11 illustrating the adaptor member rotated so that two angled flat edge surfaces of the adaptor member diagonally opposite each other engage respective side walls of the C-shaped channel, with a portion of both flanges of horizontal frame member broken away.

Another style of picture frame 70 is illustrated in FIG. 11, 12 and 13 with which the picture hanger of the present invention may be used. This picture frame 70 is formed from a metal moulding and defines of its rear face a C-shaped channel having a bottom wall 72, a pair of opposite facing side wall 74 adjacent to and connecting to either side of the bottom wall, and a pair of flanges 76 each adjacent to and connected to one of the aforementioned side walls 74.

In order to connect the picture mount member 10'' to the metal moulding of the picture frame 70, an adaptor member 78, which may be made from metal, plastic or other suitable materials, is provided to fit within the C-shaped channel at the rear of the picture frame. The adaptor member is elongated and flat surfaced and defines a centrally located threaded hole 80 for receipt thereinto of a machine screw or threaded member 82 for connection to the picture mount member. The adaptor member 78 is provided with at least two angled flat edge surfaces 84 each diagonally opposite the other. As a practical manner, the adaptor member may have four such angled flat edge surfaces 82, so that whichever way the adaptor member is flipped and inserted into the C-shaped channel, two diagonally opposite angled flat edge surfaces 84 can always be moved into engagement with the respective opposite facing side walls 74 of the C-shaped channel.

In use of the adaptor member 78, the screw or threaded member 82 is extended through the aperture 22'' within the picture mount member 10'' and into the threaded hole 80 in the adaptor member to connect the two members loosely together. The adaptor member so connected is tilted so as to fit past the flanges 76 of the C-shaped channel in the picture frame 70 to assume the position shown in FIG. 11. The screw or threaded member 82 is turned clockwise causing the adaptor member to be rotated partially within the C-shaped channel until two of the diagonally opposite angled flat edge surfaces 84, are moved into engagement with the opposite facing side walls 74 of the C-shaped channel. Further rotations of the screw or threaded member 82 will also cause the adaptor member 78 to be moved into clamped engagement against the pair of flanges 76 of the C-shaped channel. In this manner the picture mount member 10'' and the metal moulding of the picture frame 70 will be firmly secured together.

Similar elements heretofore described with respect to an earlier embodiment and not specifically mentioned with respect to this embodiment are identified with the same reference numbers, but are double primed to show that it represents another alternate embodiment.

The invention has been described in detail with particular reference to preferred embodiments thereof, but it will be understood that variations and modifications can be effected within the spirit and scope of the invention.

I claim:

1. A picture hanger comprising a T-shaped wall mount member having a horizontal portion and a vertical portion extending intermediately of and below said horizontal portion, said horizontal portion having a flat horizontal upper surface; said T-shaped wall mount member being securable on one side thereof to a wall of a room and having on the other side an elongated pendulum member pivotally mounted therefrom for indicating when the T-shaped wall mount member has been oriented on said wall to align said horizontal portion in a plane parallel to normal horizontal reference lines about said room, said T-shaped wall mount member defining within said flat horizontal upper surface two spaced similarly shaped apertures extending downwardly into said horizontal portion; and a picture mount member having a horizontally extending portion and being securable on one side thereof to the rear face of a horizontal frame member of a picture frame and having extending downwardly therefrom at right angles to the general axis of said horizontally extending portion a pair of spaced tongue members, each said tongue member being similarly configured to one of said two spaced similarly shaped apertures to engage and slide therewithin in close conformity therewith for securing said picture mount member to said T-shaped wall mount member.

2. A picture hanger as defined in claim 1, and wherein said horizontal portion defines within its flat horizontal upper surface and between said two spaced similarly shaped apertures a third aperture in the shape of a cross formed by two slots intersecting at right angles and crossing at their midpoints, one of said intersecting slots terminating in an arcuate surface at a predetermined distance below said horizontal upper surface and the other of said intersecting slots extending completely through said horizontal portion, and said elongated pendulum member being insertable lengthwise through said other intersecting slot of said third aperture and having at its upper end a pivot pin extending at right angles transversely beyond each side of said pendulum member for seating within and against said arcuate surface for pivotally supporting said pendulum member from said T-shaped wall mount member.

3. A picture hanger as defined in claim 1, and wherein said elongated pendulum member at its free extremity has a V-shaped tip and the free extremity of said vertical portion of said T-shaped wall mount member defines a centrally located inverted V-shaped opening the apex of which and said V-shaped tip of said pendulum member meet when said horizontal portion of said T-shaped wall mount member is aligned in a plane parallel to said normal horizontal reference lines about said room.

4. A picture hanger as defined in claim 1, and wherein said pair of spaced tongue members extending at right angles to said general axis of said horizontally extending portion of said picture mount member is also inclined at an angle transversely to said general axis of said horizontally extending portion.

5. A picture hanger as defined in claim 1, and wherein each of said pair of spaced tongue members has a rectangular configuration with the length of said rectangular configuration parallel to said general axis of said horizontally extending portion being greater than the width.

6. A picture hanger as defined in claim 4, and wherein said pair of spaced tongue members is inclined at an angle of about 3 degrees transversely to said general axis of said horizontally extending portion of said picture mount member.

7. A picture hanger as defined in claim 1, and wherein said picture mount member defines within the surface on said one side a longitudinally extending groove parallel to said general axis of said horizontally extending portion, and also comprising a longitudinally extending flat surfaced spacer member adapted to be interposed between said surface of said horizontal frame member of said picture frame and said one side of said picture mount member and having on one side thereof a longitudinally extending rib configured in cross-section to fit within said longitudinally extending groove in said picture mount member for aligning said spacer member with said picture mount member.

8. A picture hanger as defined in claim 7, and wherein said longitudinally extending flat surfaced spacer member defines on its other side a longitudinally extending groove parallel to said longitudinally extending rib on said one side of said spacer member and adapted to receive a longitudinally extending rib of another longitudinally extending flat surfaced spacer member.

9. A picture hanger as defined in claim 1, and wherein said T-shaped wall mount member, said pendulum member and said picture mount member are each formed in one piece by injection molding.

10. A picture hanger as defined in claim 1, and wherein said horizontal frame member of a picture frame comprises a metal moulding defining within its rear face a C-shaped channel having a bottom wall, a pair of opposite facing side walls adjacent to and connecting to either side of said bottom wall, and a pair of flanges each adjacent to and connected to one of said side walls and being parallel to said bottom wall, and said picture mount member also including a threaded member and an adaptor member connected by said threaded member to said picture mount member and adapted to fit within said C-shaped channel of said metal moulding and upon rotation of said threaded member to be clamped against said pair of flanges to secure said picture mount member to said picture frame.

11. A picture hanger as defined in claim 10, and wherein said adaptor member comprises a flat surfaced elongated member defining a centrally located threaded hole for receipt therethrough of one end of said threaded member and having at least two angled flat edge surfaces each diagonally opposite the other and adapted to engage one of said opposite facing side walls of said C-shaped channel prior to said adaptor member being clamped against said pair of flanges and upon partial rotation of said adaptor member as said threaded member is being rotated.

* * * * *